United States Patent [19]

Sassak

[11] 4,385,514

[45] May 31, 1983

[54] PIPE ASSEMBLY TOOL

[75] Inventor: Frank Sassak, Riverview, Mich.

[73] Assignee: McInerney Spring & Wire Company, Grand Rapids, Mich.

[21] Appl. No.: 281,444

[22] Filed: Jul. 8, 1981

[51] Int. Cl.[3] ..... B21D 39/04

[52] U.S. Cl. ..... 72/416; 29/508; 30/96; 72/453.15

[58] Field of Search ..... 72/416, 412, 410, 453.15, 72/453.16; 30/96; 29/508, 511

[56] References Cited

U.S. PATENT DOCUMENTS

| | | | |
|---|---|---|---|
| 676,292 | 6/1901 | Wigtel | 72/416 |
| 2,030,803 | 2/1936 | Temple | 72/416 |
| 3,889,340 | 6/1975 | Dixon | 72/416 |
| 3,919,877 | 11/1975 | Netta | 72/416 |
| 3,937,050 | 2/1976 | Nicholson | 72/416 |
| 4,018,462 | 4/1977 | Saka | 29/508 |
| 4,132,101 | 1/1979 | Abramson | 72/416 |
| 4,216,668 | 8/1980 | Walton | 72/412 |

FOREIGN PATENT DOCUMENTS

| | | | |
|---|---|---|---|
| 67589 | 9/1948 | Denmark | 72/416 |

*Primary Examiner*—Gene Crosby

*Attorney, Agent, or Firm*—Cullen, Sloman, Cantor, Grauer, Scott & Rutherford

[57] ABSTRACT

A pipe assembly tool adapted to swedge a ring onto the overlap of a pair of telescoped pipes for securing them together, comprises a pair of aligned swedge die blocks, each having opposed semicircular channels of semicircular cross section, adapted to receive a ring of circular cross-section upon the overlap of a pair of telescoped pipes. A power cylinder has a cross head which mounts a pair of die supports at their one ends. The die blocks span and are mounted upon the die supports at their other ends. A piston rod connects one of the die blocks for moving it into operative compression relative to the other die block, the ring forming concentric channels in the pipes, a peripheral seal therebetween, a bead in one pipe nested within a channel of the other pipe, the ring being nested and interlocked within one channel. A pipe shear has a pair of aligned pivotally connected shear die blocks which replace the swedge die blocks, the shear blocks having opposed semi-circular recesses for securing a pipe therebetween when the shear die blocks are drawn together. An elongated shear blade is interposed between the piston rod and one of the die blocks and is guidably received by the die blocks. Compressive movement of the piston rod advances the shear blade through the pipe.

5 Claims, 11 Drawing Figures

PIPE ASSEMBLY TOOL

BACKGROUND OF THE INVENTION

Heretofore in connecting a pair of telescoped engaging pipes, such as the outlet of a muffler and a corresponding exhaust pipe of a vehicle, though not limited thereto, there has long existed the problem of effectively securing the pipes together at their overlap and at the same time providing a seal between the assembled pipes and for securing the clamp to the outer pipe.

Various clamp assemblies have heretofore been employed to interconnect the pipes at their overlap. The difficulty with current pipe clamps is that they do not provide an effective mechanical interlock between the pipes and do not provide an efficient seal therebetween to prevent the escape of exhaust gases to atmosphere, nor a positive interlock between the clamp and the pipes.

Heretofore, various clamp assemblies employed for this purpose use fasteners to provide an initial friction interlock between the overlapped pipes usually requiring drawing up and tightening of clamp parts by bolts and nuts. Vibration often times causes the nuts to become loosened and the clamp rendered ineffective.

RELATED PATENT APPLICATION

In accordance with the patent application copending herewith, referred to as Pipe Clamp and Clamping Method, filed May 21, 1981, Ser. No. 265,901, there has been provided an improved pipe clamp and clamping method by which a pair of telescoping engaging pipes have been secured together at their overlap by the use of a ring of circular cross-section applied to the pipes at the overlap and wherein power means are employed for shrinking or swedging the ring onto the assembled pipes for securing and sealing the pipes together concentric annular channels are formed in the pipes with an annular bead formed in one pipe, nested within the channel of the other pipe and with portions of the shrunk ring nested within the annular channel of one of the pipes and interlocked therewith.

SUMMARY OF THE INVENTION

An important feature of the present invention is to provide an improved assembly tool which is adapted to swedge a ring onto the overlap of a pair of telescoped engaging pipes for securing and sealing them together. A further feature is to provide a pair of aligned die blocks, each having opposing semicircular channels of semicircular cross-section, adapted to receive a ring of circular cross-section upon the overlap of a pair of telescoped pipes. The power cylinder has a crosshead which mounts a pair of die supports at their one ends. The die blocks span are mounted upon the die supports a their other ends. The piston rod engages one of the die blocks for moving it into operative compression with the other die block, the ring forming concentric channels in the pipes, a peripheral seal therebetween, a bead in one pipe nested within the channel of another pipe and with the ring nested and interlocked within one channel.

A further feature is to provide the pair of die blocks so as to span a pair of die supports with one of the die blocks movably and guidably mounted therein whereby pressurization of the cylinder causes its piston rod to operatively engage one die block moving it into compressive engagement with the other die block and for swedging and shrinking the ring therebetween onto the pair of assembled pipes at their overlap.

A further feature includes a modification in the form of a pipe shear which employs a pair of aligned pivotally connected shear die blocks which replace the swedge die blocks wherein the pipe shear blocks have opposed semicircular recesses therein for securing a pipe therebetween when the die blocks are drawn together. An elongated shear blade is interposed between the piston rod and one of the die blocks and is guidably received by the die blocks so that compressive movement of the piston rod advances the shear blade through the pipe.

These and other objects will be seen from the following specification and claims in conjunction with the appended drawings.

THE DRAWINGS

DETAILED DESCRIPTION OF AN EMBODIMENT OF AN INVENTION

Figure 1:
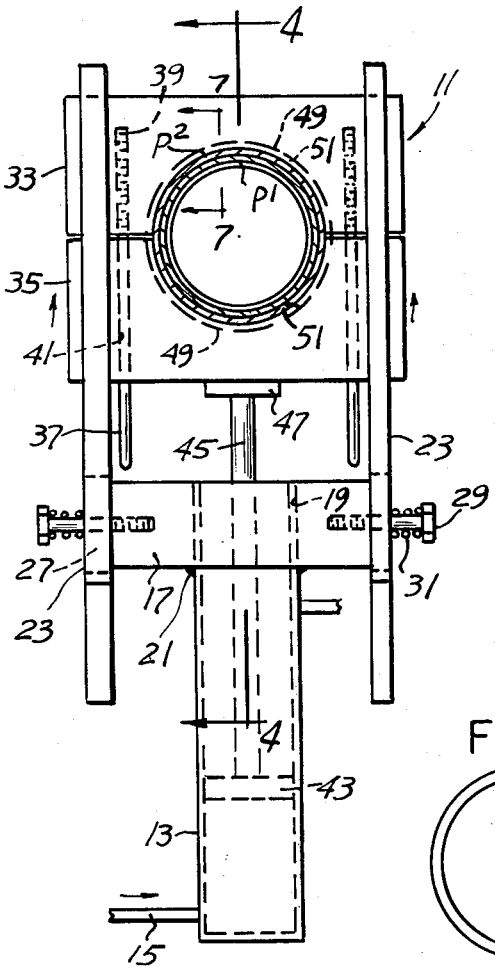
FIG. 1 is a side elevational view of the pipe assembly tool with the swedge die blocks in operative engagement with a clamp ring.
Figure 2:
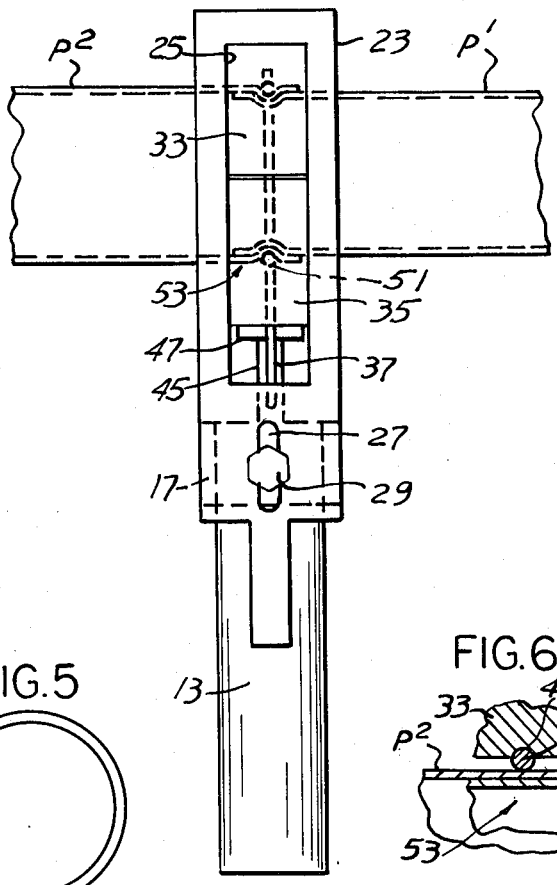
FIG. 2 is a right side elevational view thereof illustrating a pair of telescoped pipes extending between the die blocks mounting a clamp ring to be secured thereto.
Figure 5:
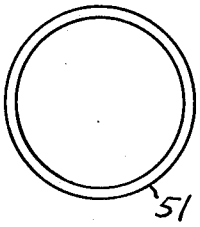
FIG. 5 is a side elevational view of the clamp ring.

The present pipe assembly tool is generally indicated at 11, FIGS. 1 and 2 and includes a single acting power cylinder 13 having a pressure conduit 15 adapted for connection to a source of air pressure for illustration and mounting upon one end the crosshead 17. Said crosshead has a bore 19 into which one end of the cylinder 13 is projected and suitably secured as by weld 21 or any other fastening means.

A pair of opposed parallel spaced die supports 23 at their lower ends are adjustably secured to said cross head by a pair of fasteners 29 which project through elongated slots 27 in the die supports and are threaded into said crosshead. In the illustrative embodiment coil springs 31 are interposed in compression between the head of the fastener 29 and the adjacent die support 23. The first die block 33 extends through the opposed pair of elongated slots 25 formed through the one ends of the die supports spanning said supports and is suitably secured thereto.

A movable second die block 35 aligned with die block 33 extends through apertures 25 spanning said supports and is movably mounted therein under the control of the power cylinder 13. Guide rods 37 at their upper ends are threaded up into the first die block 33 and guidably extend through corresponding bores 41 in the second die block 35. The threading is shown at 39, FIG. 1.

A cylinder assembly includes cylinder 13, piston 43 and connected piton rod 45, partly shown in dash lines, which projects from the cylinder and at its outer end mounts the pressure plate 47 adapted for engagement with the second die block 35. The inoperative position of the die block is shown in FIG. 3 wherein second die block 35 is retracted.

Figure 3:
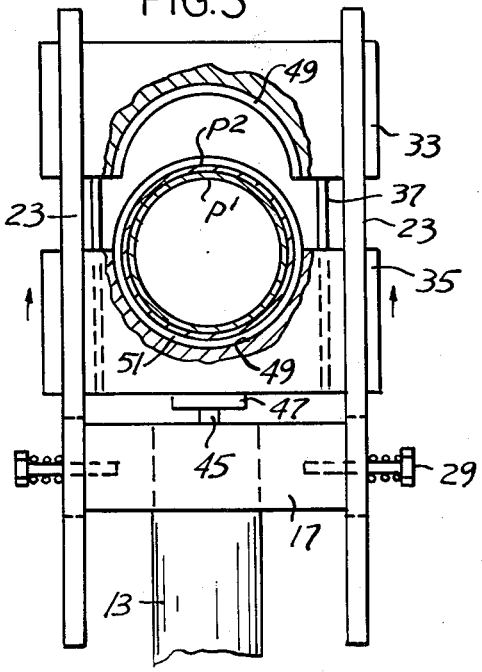
FIG. 3 is a fragmentary view similar to FIG. 1 showing the swedge die blocks separated with the telescoped pipes and clamp ring assembled and mounted upon the movable die block.

A pair of telescoped engaging pipes P1 and P2 are fragmentarily shown in FIG. 2 and shown in position in FIGS. 1 and 3 wherein at their overlap 53 between the pipes there has been initially applied clamp ring 51.

Each of the die blocks 33 and 35 have oppositely arranged semicircular channels 49 which are semicircular in cross-section and which are adapted to receive and compressively engage ring 51 when the die blocks are forcefully brought together, such as shown in FIG. 1.

Upon applying pressure fluid such as compressed air to the cylinder conduit 15, the second die block 35 with the then assembled overlapped pipes P1 and P2 and corresponding clamp ring 51 positioned thereon are moved into operative engagement with the first die block 33. Under the action of power cylinder 13 the corresponding dies 33 and 35 when brought together, there is a shrinking or swedging action of the ring 51 with respect to the assembled pipes.

Figure 6:
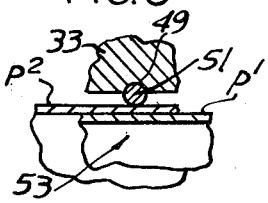
FIG. 6 is a fragmentary section taken in the direction of arrows 7—7 of FIG. 1 showing portions of the ring and pipes be for die action.
Figure 7:
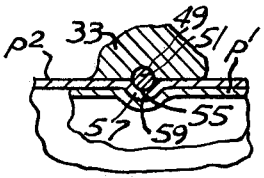
FIG. 7 is a similar view after die action.

The arrangement of the ring with respect to the pipes before compression is shown fragmentarily in FIG. 6 and further shown after compression and shrinking in FIG. 7.

It is seen from the compressive swedging action wherein the ring inner and outer diameters are slightly reduced, there is formed within the outer pipe P2 an annular channel 55, and concentric therewith within the inner pipe corresponding annular channel 59. Further there is formed within the outer pipe P2 inwardly of channel 55 a corresponding concentric annular bead 57 which interlockingly nests and seals within channel 59. After shrinking of ring 51 the second die block 35 is retracted. This can occur by the action of springs for disengaging the second die. Application of pressure fluid to the opposite end of the cylinder may be employed for retracting the piston rod to the inoperative position shown in FIG. 3.

Figure 4:
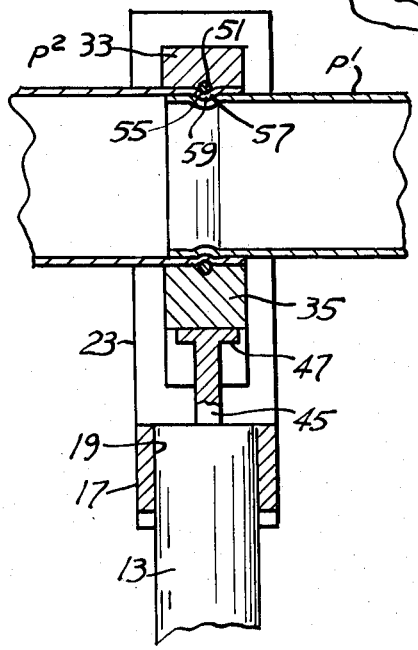
FIG. 4 is a fragmentary vertical section taken in the direction of arrows 4—4 of FIG. 1.
Figure 9:
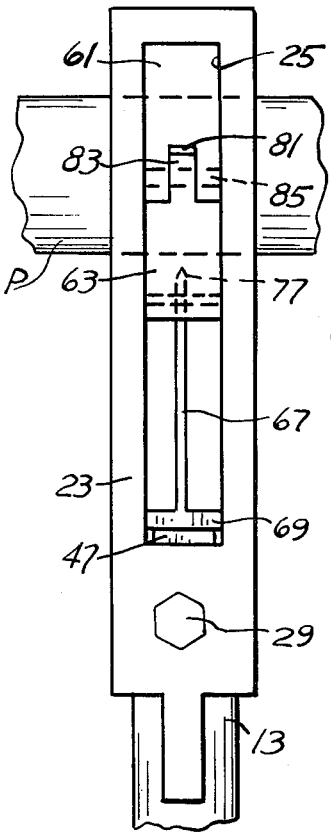
FIG. 9 is a fragmentary left side elevational view thereof.

In any event, after the retraction of the second die 35, the assembled and secured together pipes P1 and P2 with interlocked clamp ring 51, are removed from the die blocks ready for use. There is therefore provided by the pipe assembly tool in FIGS. 1 through 7 a means by which two pipes are secured together at their overlap at 53, such as shown in FIGS. 2, 4 and 7 and wherein there is provided a peripheral seal between the pipes throughout 360°.

Additional, there is a mechanical interlock between the ring 51 and the outer pipe P2 so that it cannot be disengaged therefrom. Additionally, there is a mechanical annular interlock between the inner and outer pipes wherein the internal annular bead 57 of the outer pipe interlockingly nests within the corresponding annular channel 59 formed in the inner pipe.

The present pipe assembly tool may also be utilized as a tool for shearing a pipe such as shown in the drawings, FIGS. 8 through 11. Here the swedge die plates 33 and 35 have been replaced by top die clamp block 61 and a bottom die clamp block 63.

The blocks 61 and 63 are projected through the corresponding slots 25 of the die supports 23 with the top block 61 suitably secured thereto or otherwise anchored adjacent the one ends of said die supports. Each of the shear die blocks 61 and 63 have opposing semicircular recess 65 formed therein adapted to compressively receive and clamp the pipe P therebetween for the shearing action. The shear die blocks 61 and 63 are pivotally interconnected at their one ends as by the tongue 83 of the shear block 63 projected within a central recess 81 of the shear block 61 and connected thereto by the transverse pivot pin 85.

Figure 8:
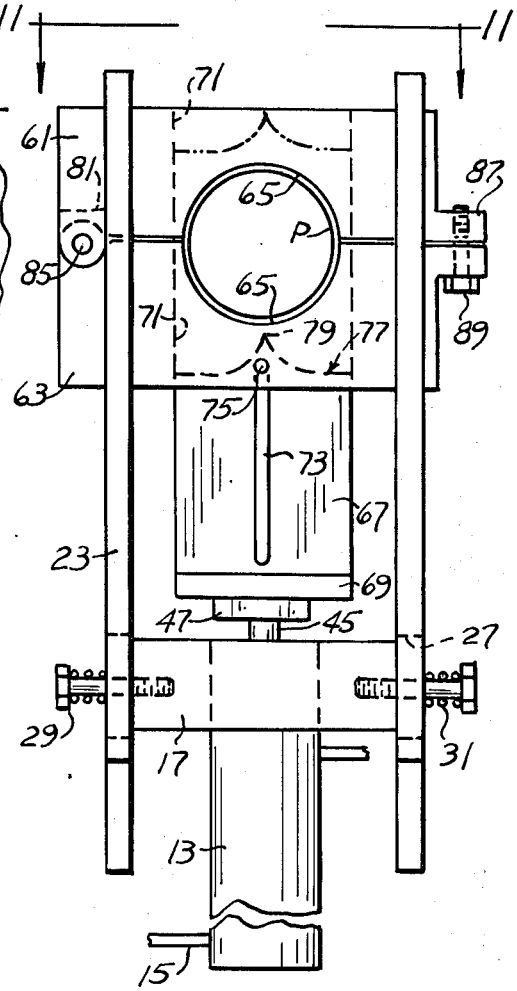
FIG. 8 is a side elevational view of a pipe shear corresponding to FIG. 1 with the swedge die blocks replaced by a pair of shear die blocks connected together.
Figure 10:
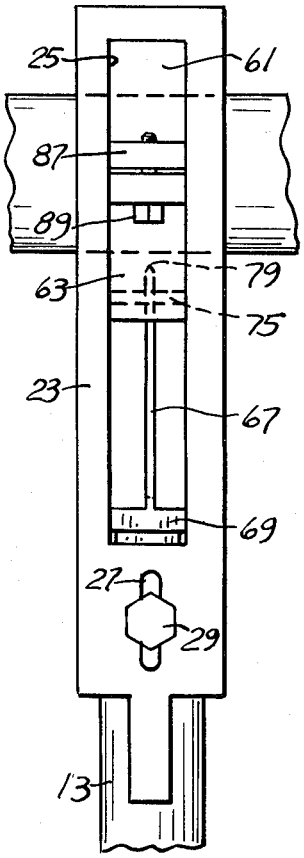
FIG. 10 is a fragmentary right side elevational view thereof.
Figure 11:
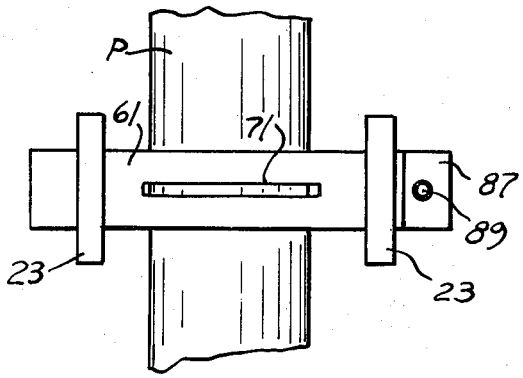
FIG. 11 is a fragmentary plan view taken in the direction of arrows 11—11 of FIG. 8.

The shear blocks 61 and 63 at their opposite ends have a pair of outwardly extending lock flanges 87 shown in registry in FIG. 8 and drawn together by a fastener 89. There is such sufficient spacing between the opposing faces of the die blocks that upon tightening of said fastener drawing the block flanges 87 together, pipe P is frictionally gripped between the die blocks ready for a shearing action.

An elongated shear blade 67 having a transverse blade support 69 at one end, is interposed between pressure plate 47 on the piston rod 45 and at its upper end, guidably extends into the longitudinal blade slot 71, which extends through shear block 63. A corresponding aligned guide slot 71 is formed in the other shear block 61 adapted to receive the shear blade when advanced to the dash line position shown in FIG. 8 under the control of power cylinder 13.

The shear blade is further guided and retained with respect to shear block 63 by the transverse pin 75 which extends through block 63 and through a corresponding elongated slot 73 formed through shear blade 67.

The upper end of the shear blade 67 has a central piercing crown or apex 79 which terminates in a pair of downwardly and outwardly extending sharp cutting curved edges 77.

Therefore, on initial upward forceful projection of the shear blade 67, the crown 79 starts the initial shearing action by moving transversely of the pipe and thereafter the shear blade continues longitudinally in the upward direction shown in FIG. 8 and is guided through the block slot 71 to the dash line position shown, shearing the pipe into two parts.

The construction of the crosshead 17 and die supports 23 is exactly the same as above described with respect to FIGS. 1, 2 and 3 where it appears that the lower ends of the die supports 23 are adjustably secured by the fasteners 29 to opposite ends of crosshead 17 secured upon power cylinder 13, fragmentarily shown in FIG. 8.

The piston rod 45 may be spring biased to automatically retract the piston rod to an inoperative position such as shown in FIG. 3, when the power has been disconnected from conduit 15. Alternately the cylinder may be provided with an additional conduit at its opposite end by which pressure fluid such as compressed air may be directed to the opposite end of the cylinder for retracting the shear blade 67 such as to the lowermost position shown in FIG. 8 prior to a subsequent shearing action. This is further showing FIGS. 9 and 10.

There is thus provided a means by which the same pipe assembly tool such as described with respect to FIGS. 1 and 7 for securing a pair of telescoped pipes together may be employed by the substitution of the shear blocks 61 and 63 for shearing one pipe as desired.

Having described my invention, reference should now be had to the following claims.

I claim:

1. A pipe assembly tool adapted to swedge or shrink a ring onto the overlap of a pair of telescoped pipes comprising:

a power cylinder assembly including a cylinder, a piston and piston rod projecting from said cylinder, and a pressure conduit adjacent one end of the cylinder;

a cross head secured to the rod end of said cylinder;

a pair of parallel spaced die supports adjacent their one ends, secured to said cross head, and at their other ends having a pair of opposed elongated guide slots;

a first die block spanning and projecting through said die supports and secured thereto;

a retractable second die block aligned with said first die block spanning and projecting through said supports and movable longitudinally thereof;

each of said die blocks having therein opposed semi-circular channels of semi-circular cross section;

said channels having a diameter less than the outside diameter of a ring and adapted to receive said ring upon the overlap of a pair of telescoped pipes extending between said dies;

a pressure plate on said piston rod engageable with said second die when retracted;

pressurizing said cylinder assembly forcefully engaging said ring within and between said dies and swedging the ring onto the overlap of said pipes.

2. In the pipe assembly tool of claim 1, the internal diameter of said ring being reduced, forming concentric outer annular channels in said pipes and a corresponding inner annular bead on the outer pipe nested within the channel upon the inner pipe, providing an annular mechanical interlock and seal between said pipes throughout 360° and an annular mechanical interlock between said ring and outer pipe.

3. In the pipe assembly tool of claim 1, a pair of parallel spaced guide rods secured to and depending from said first die block and extending through corresponding parallel spaced bores in said second die block.

4. In the pipe assembly tool of claim 1, each die support at its one end having an elongated mount slot;

the securing of said die supports to said crosshead including a headed bolt extending through each mount slot and threaded into said cross head.

5. In the pipe assembly tool of claim 4, and a coil spring on each bolt interposed between its head and the adjacent die support.

* * * * *